US006930267B2

(12) United States Patent
Chou

(10) Patent No.: US 6,930,267 B2
(45) Date of Patent: Aug. 16, 2005

(54) EMERGENCY SWITCH PROVIDED WITH MEANS TO SIGNIFY STATE OF ACTIVATION OR INACTIVATION THEREOF

(76) Inventor: Tsung-Kui Chou, No. 30,Alley 15, Lane kuang-ming 6th Rd., Jhubei, Hsinchu (TW)

( * ) Notice: Subject to any disclaimer, the term of this patent is extended or adjusted under 35 U.S.C. 154(b) by 274 days.

(21) Appl. No.: 10/671,917

(22) Filed: Sep. 24, 2003

(65) Prior Publication Data

US 2005/0061651 A1 Mar. 24, 2005

(51) Int. Cl.[7] ..... H01H 13/14

(52) U.S. Cl. ..... 200/520; 200/334; 200/341; 200/43.01

(58) Field of Search ..... 200/520, 333, 200/334, 341, 43.01, 43.07, 537, 329

(56) References Cited

U.S. PATENT DOCUMENTS 3,426,168 A * 2/1969 Hansen ..... 218/138
3,895,205 A * 7/1975 Tharp ..... 200/318.2
4,370,532 A * 1/1983 Green ..... 200/314
4,744,307 A * 5/1988 Peterman et al. ..... 104/295
4,918,266 A * 4/1990 Dalebout et al. ..... 200/52 R
5,945,647 A * 8/1999 Hoskins ..... 200/18
6,483,058 B2 * 11/2002 Ehrensberger ..... 200/302.2

* cited by examiner

*Primary Examiner*—Kyung Lee
(74) *Attorney, Agent, or Firm*—W. Wayne Liauh

(57) ABSTRACT

An emergency switch comprises a base on which an electrical circuit switch, and an indicator pin are mounted. An activation body is provided with an activation projection and a torsion spring and is movably mounted on the indicator pin. A trigger button is provided with a through hole and is fastened with a top end of the activation body. When the trigger button is triggered, the activation body is forced to move downwards along the indicator pin, so as to cause the activation projection to turn off the electrical circuit switch. A top end of the indicator pin is jutted out of the through hole of the trigger button to indicate that the emergency switch is in the state of activation.

3 Claims, 10 Drawing Sheets

EMERGENCY SWITCH PROVIDED WITH MEANS TO SIGNIFY STATE OF ACTIVATION OR INACTIVATION THEREOF

FIELD OF THE INVENTION

The present invention relates to an emergency switch which is provided with a means to enable a machine operator to tell easily if the emergency switch is activated.

BACKGROUND OF THE INVENTION

The electrically-operated machine is generally provided with an emergency switch serving as a safety device. The emergency switch is activated under circumstances demanding an immediate cessation of operation of the machine.

As shown in FIGS. 1–3, the Taiwan Patent Serial Number 90207473 discloses an emergency switch 1 comprising a cover 2 which is formed of a frame 3 and a press piece 4 fastened to the frame 3. In the event that the emergency switch 1 has to be activated, the press piece 4 is pressed with finger to separate from the frame 3, thereby making the emergency switch 1 accessible. The press piece 4 is intended to prevent the emergency switch 1 from being activated accidentally.

Such a prior art emergency switch as described above is defective in design in that the activation of the emergency switch is delayed by a chore of severing the press piece, and that the finger of a machine operation is susceptible to injuries in the course of severing the press piece, and further that the emergency switch must be provided with a new cover in the wake of the activation of the emergency switch.

As shown in FIGS. 4 and 5, a prior art emergency switch 5 is mounted on a control panel 6 such that the emergency switch 5 is immediately accessible. This prior art emergency switch is vulnerable to an accidental activation. In addition, it is devoid of a means to enable a machine operator to tell with ease and speed if the emergency switch is in the state of activation or inactivation.

SUMMARY OF THE INVENTION

The primary objective of the present invention is to provide an emergency switch structure which is free of the deficiencies of the prior art emergency switches described above.

The emergency switch structure of the present invention comprises a base, a movable hollow body, an indicator pin, and a button. The base has a bottom on which the movable hollow body is mounted. The indicator pin is fastened at a bottom end with the bottom of the base such that the indicator pin is put through the hollow body. The button is fastened with a top end of the movable hollow body and is provided with a through hole in alignment with the indicator pin. When the button is triggered, the movable hollow body is activated to interrupt the power supply. Meanwhile, the top end of the indicator pin emerges from the through hole of the button. As the button is relieved of the external force exerting thereon, the button is pushed by a spring force of the movable hollow body to return to its original position. As a result, the top end of the indicator pin is no longer visible.

The features and the advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
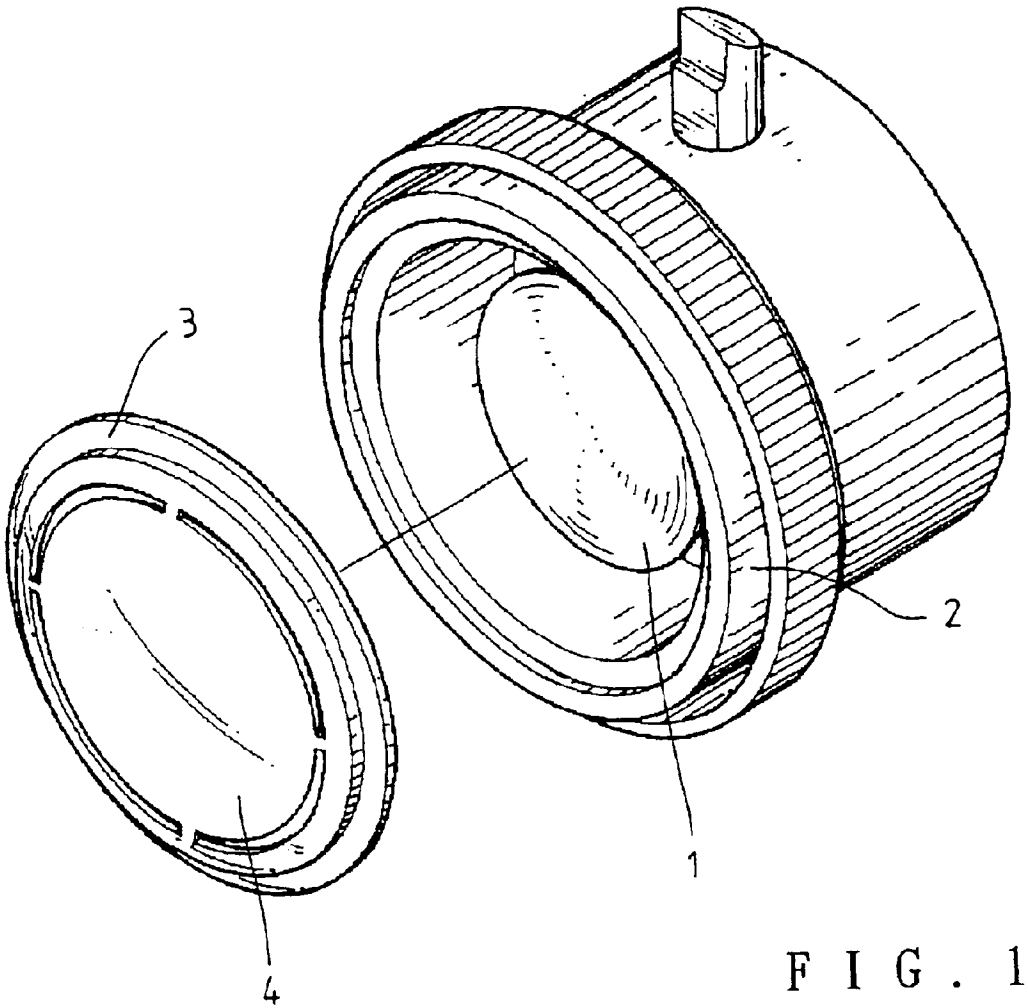
FIG. 1 PRIOR ART
FIG. 1 shows an exploded view of a first prior art emergency switch.
Figure 2:
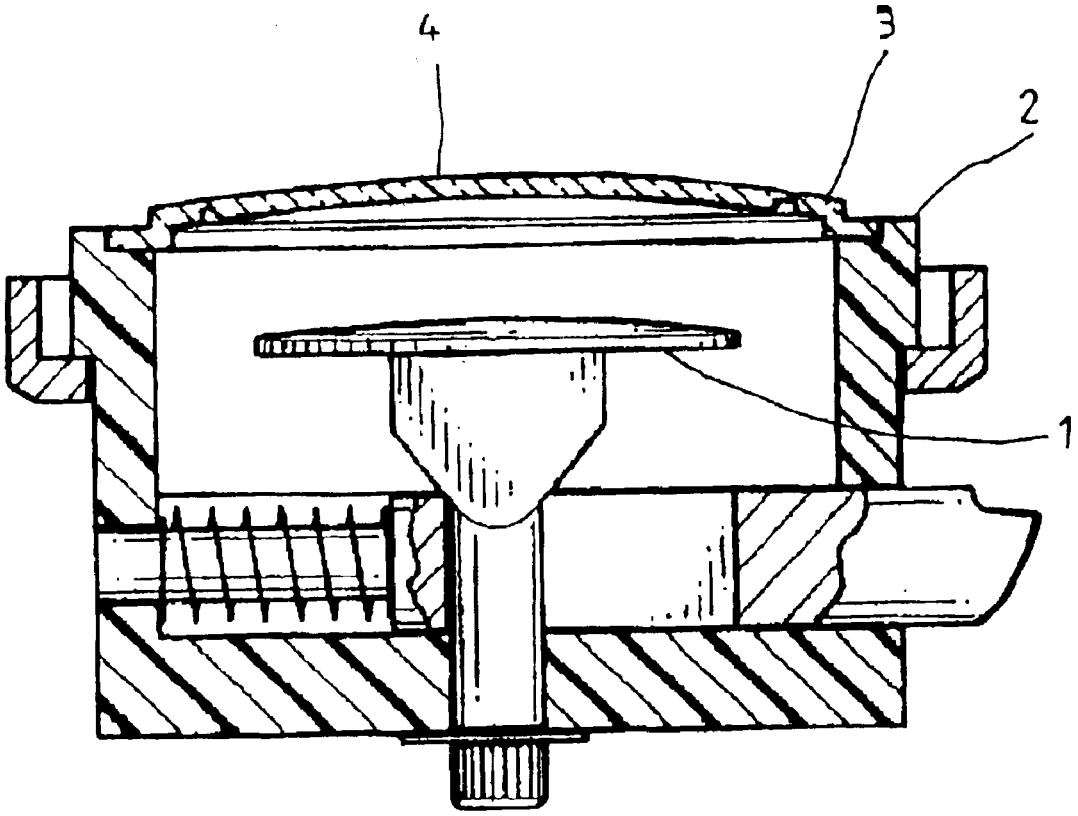
F I G . 2 PRIOR ART
FIG. 2 shows a sectional schematic view of the first prior art emergency switch in combination.
Figure 3:
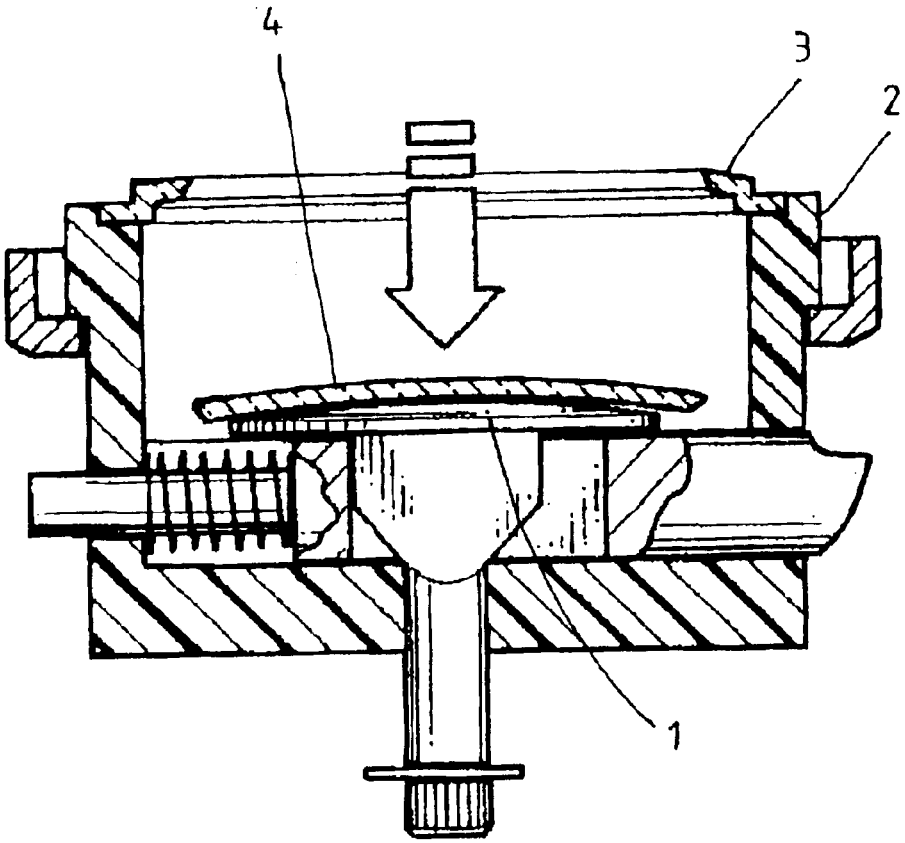
F I G . 3 PRIOR ART
FIG. 3 shows a sectional schematic view of the first prior art emergency switch at work.
Figure 4:
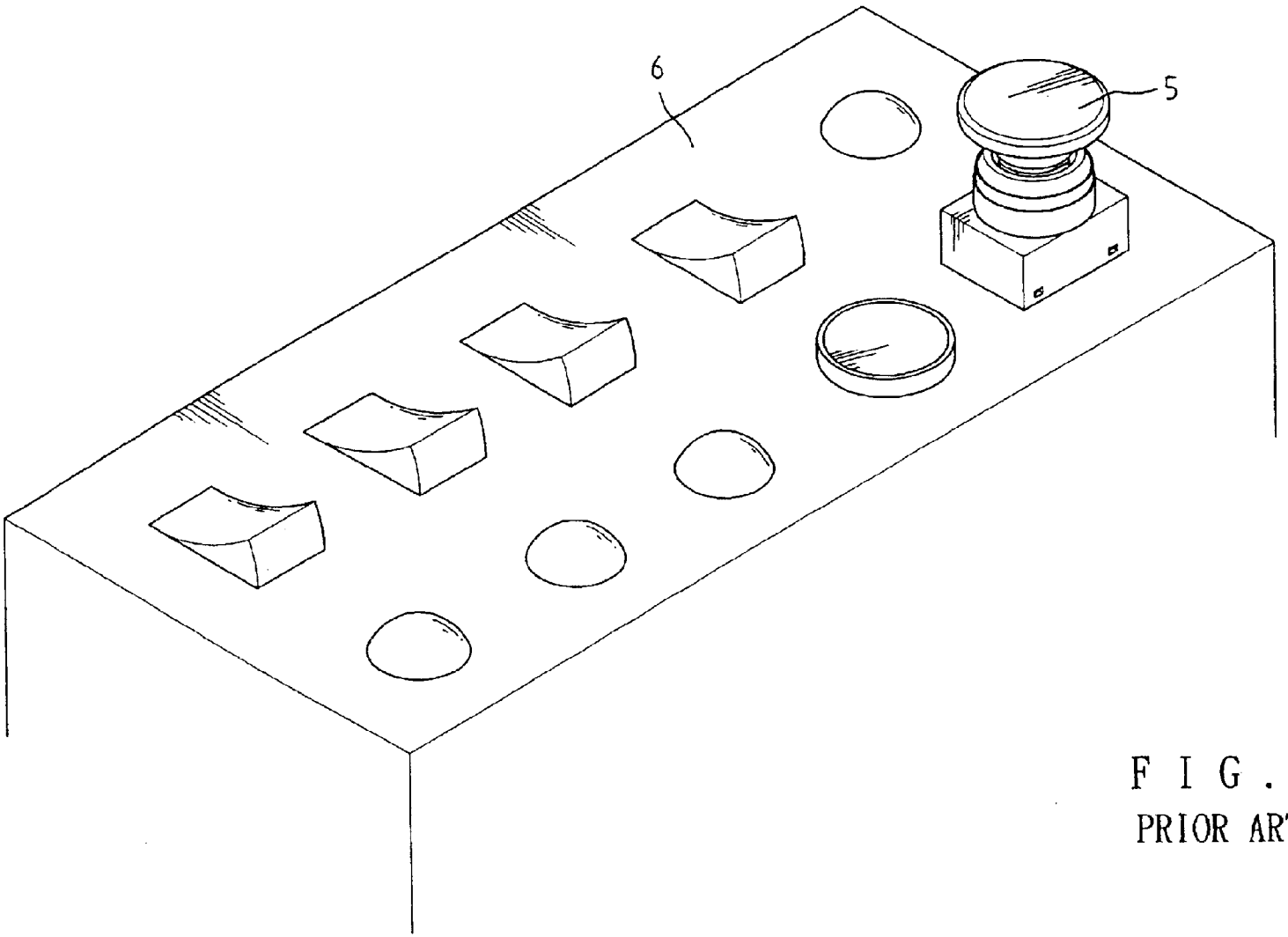
FIG. 4 PRIOR ART
FIG. 4 shows a perspective view of a second prior art emergency switch.
Figure 5:
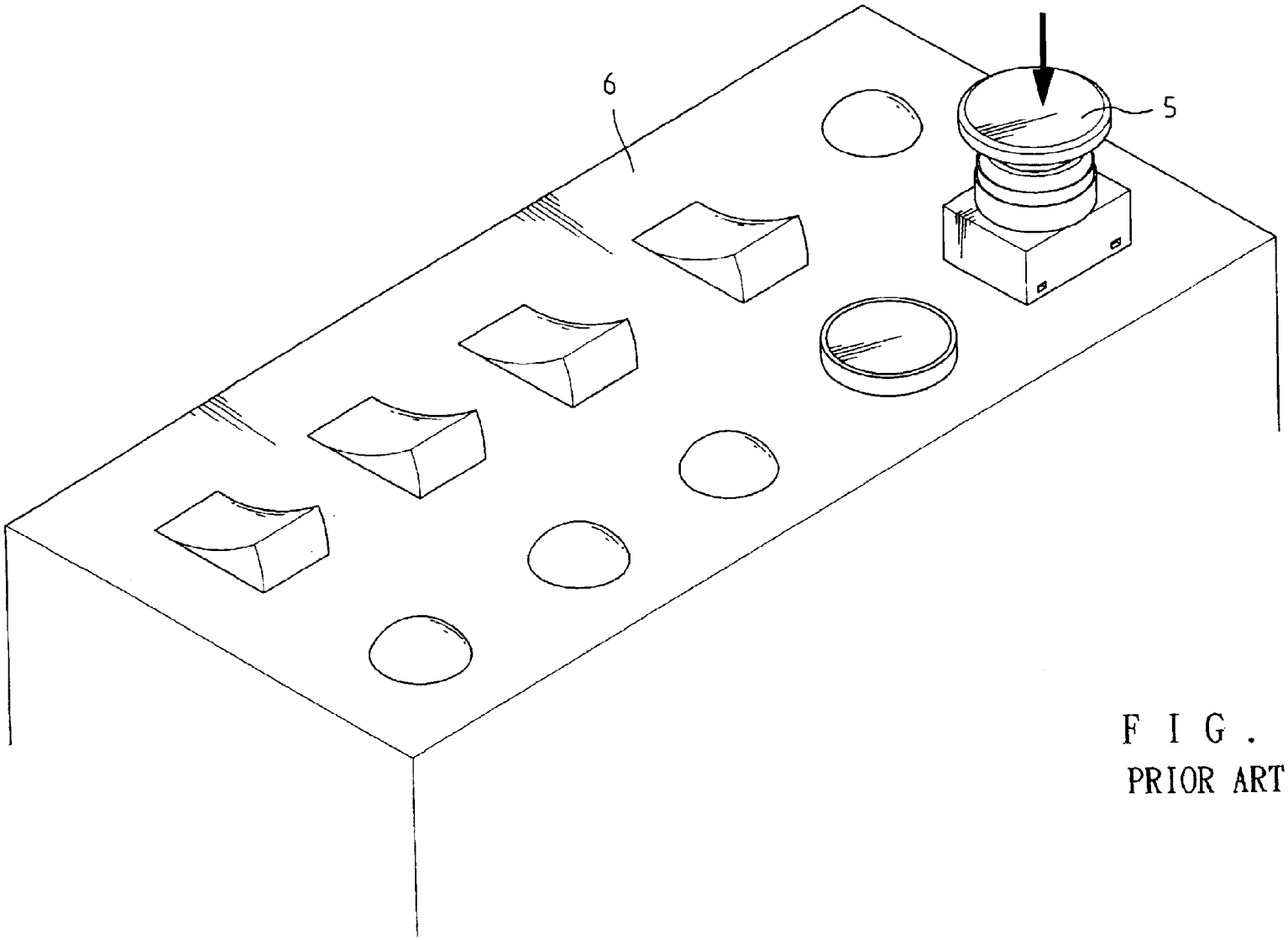
FIG. 5 PRIOR ART
FIG. 5 shows a schematic view of the second prior art emergency switch at work.
Figure 6:
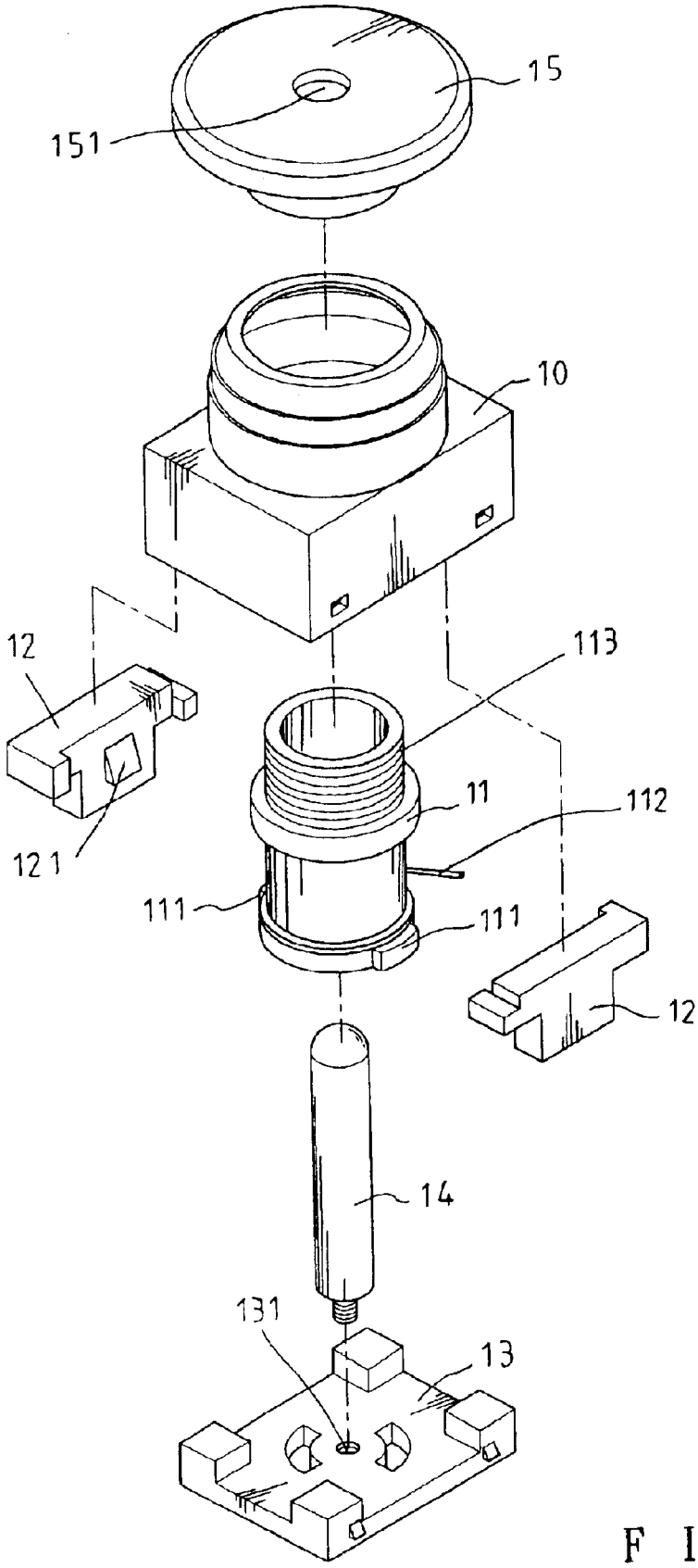
FIG. 6 shows an exploded view of the preferred embodiment of the present invention.
Figure 7:
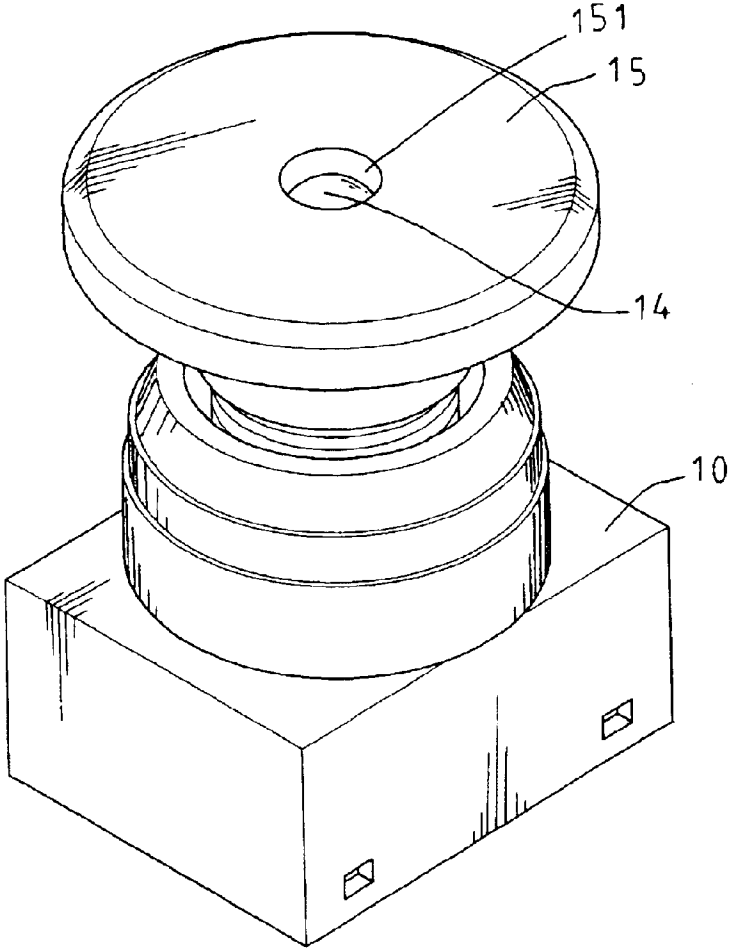
FIG. 7 shows a perspective view of the preferred embodiment of the present invention in combination.

As shown in FIGS. 6–10, an emergency switch embodied in the present invention comprises a housing 10, an activation body 11, two circuit switch seats 12, a base 13, an indicator pin 14, and a trigger button 15.

The base 13 is provided in the center of the upper side thereof with a threaded hole 131 for fastening a bottom end of the indicator pin 14. The two circuit switch seats 12 are mounted on the upper side of the base 13 such that they are opposite to each other, and that they can be connected to the electrical circuits of a machine. The circuit switch seats 12 are provided with a circuit switch 121.

The activation body 11 is provided in the outer wall of a bottom end with two activation projections 111 opposite in location to each other, and in the outer wall of a midsegment with a torsion spring 112 fastened therewith. The activation body 11 is provided at a top end with a male threaded portion 113. The activation body 11 is movably mounted on the indicator pin 14 such that the two activation projections 111 are respectively aligned with the circuit switches 121 of the circuit switch seat 12.

The housing 10 is mounted on the base 13 to cover the the circuit switch seats 12, the activation body 11, and the indicator pin 11. The trigger button 15 is provided in the underside with a female threaded hole (not shown in the drawings), and in the center with a through hole 151 concentric with the female threaded hole. The trigger button 15 is fastened with the activation body 11 such that the female threaded hole of the trigger button 15 is fastened with the male threaded portion 113 of the top end of the activation body 11, and that the trigger button 15 is jutted out of the housing 10.

When the trigger button 15 is pressed, the activation body 11 is pushed to move downwards along the indicator pin 14. As a result, the two activation projections 111 of the activation body 11 come in contact with the two circuit switches 121, so as to bring about the power interruption. In the meantime, the top end of the indicator pin 14 is jutted out of the trigger button 15 via the through hole 151 of the trigger button 15 to indicate that the emergency switch of the present invention is in the state of activation. It must be noted here that top end of the indicator pin 14 is not visible at the time when the emergency switch of the present invention is in the state of inactivation.

Figure 8:
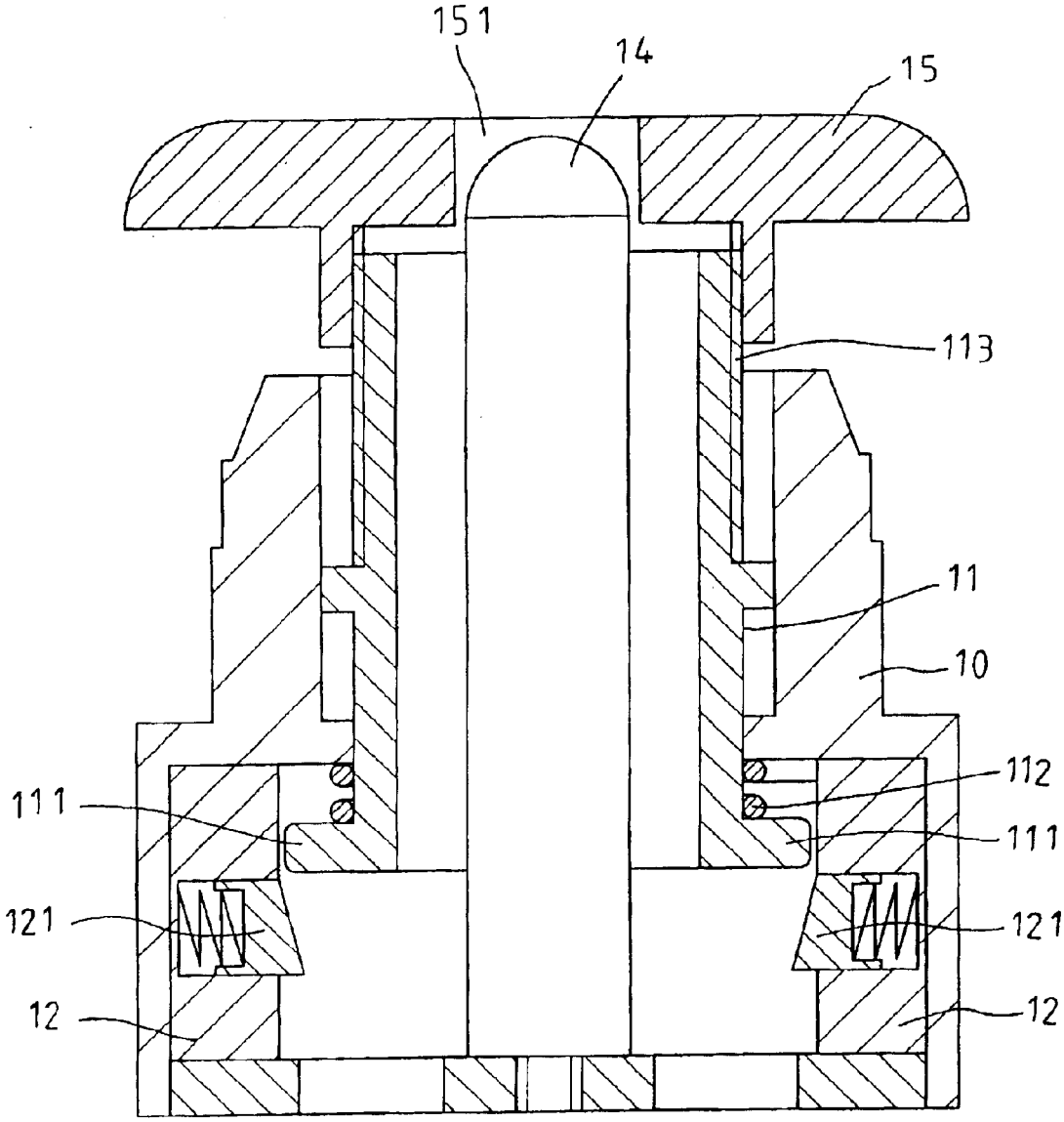
FIG. 8 shows a sectional schematic view of the preferred embodiment of the present invention as shown in FIG. 7.
Figure 9:
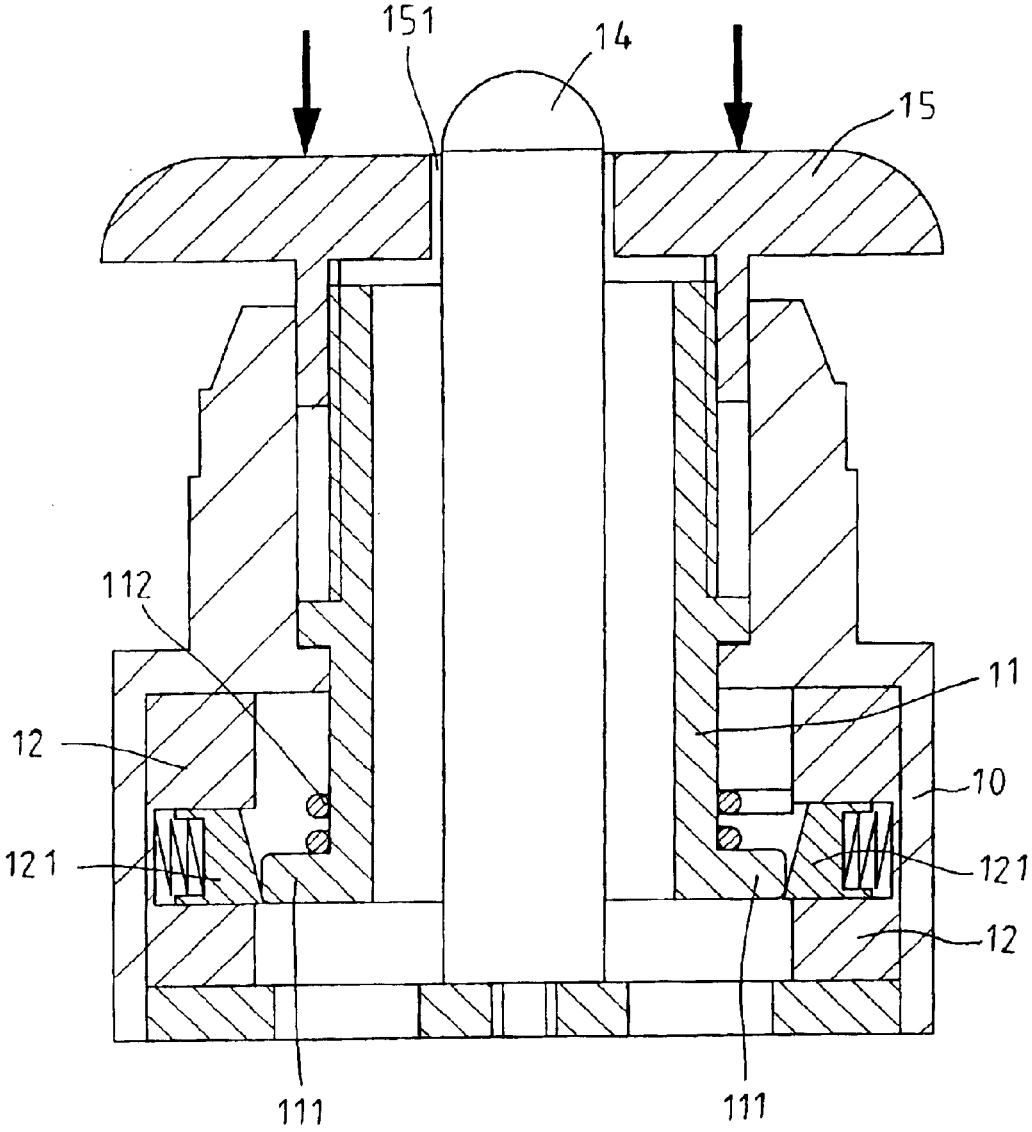
FIG. 9 shows a sectional schematic view of the preferred embodiment of the present invention at work.
Figure 10:
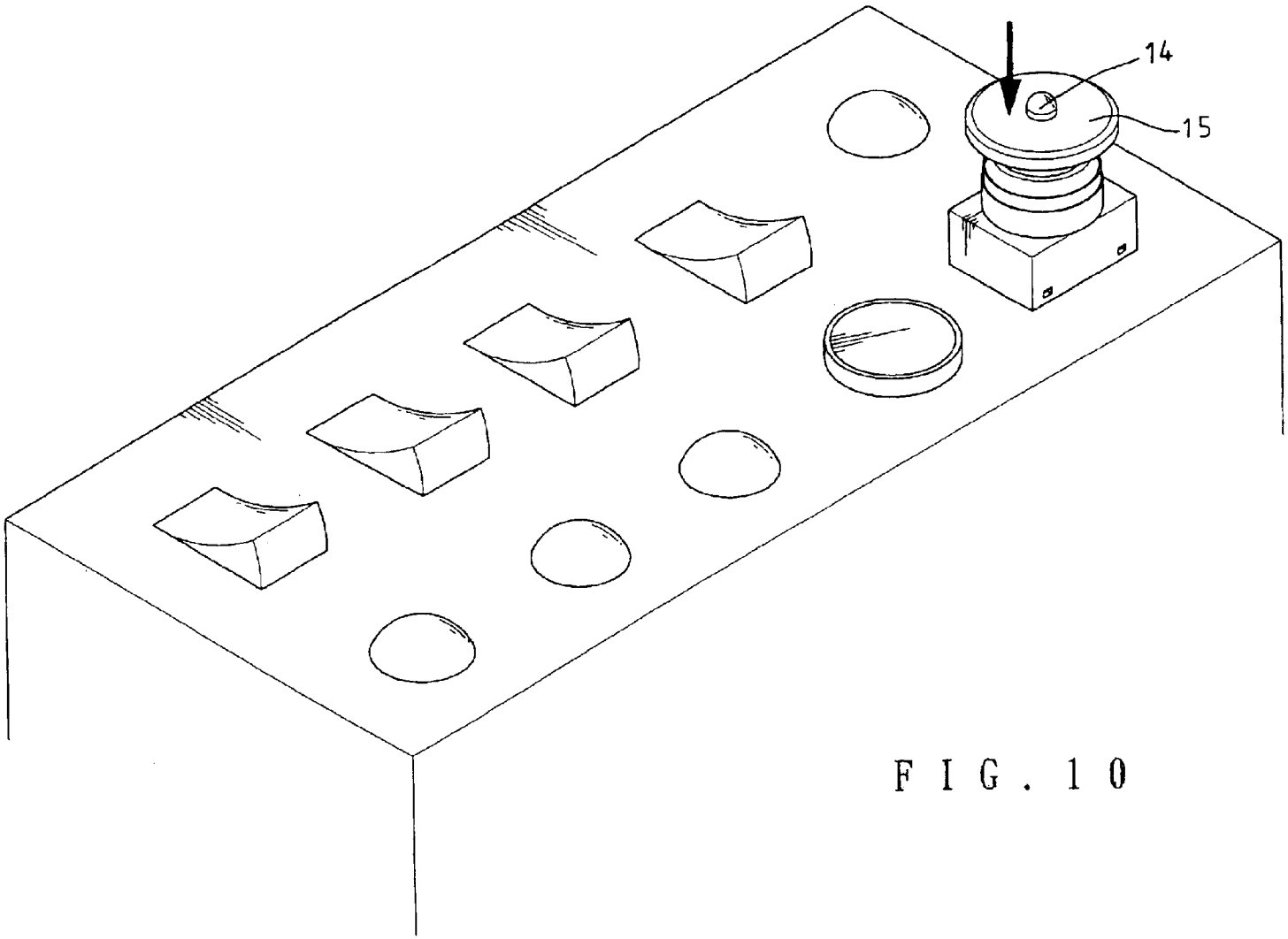
FIG. 10 shows a perspective view of the preferred embodiment of the present invention along with a control panel.

As soon as the trigger button 15 is relieved of the external force exerting thereon, the activation body 11 is forced by the spring force of the torsion spring 112 to return to its original position. Meanwhile, the trigger button 15 is also caused to return to its original position. As a result, the top end of the indicator pin 14 is no longer visible, as shown in FIG. 8.

In order to make the top end of the indicator pin 14 conspicuous, the top end of the indicator pin 14 is different in color from the trigger button 15.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. An emergency switch comprising:

a base;

an indicator pin having a length and being fastened at a bottom end with said base;

at least one electrical circuit switch mounted on said base;

an activation body provided with at least one activation projection and a torsion spring wherein said activation body is movably mounted on said indicator pin in such a way that said activation projection is aligned with said electrical circuit switch; and a trigger button provided with a through hole and fastened to a top end of said activation body in such a manner that said through hole is in alignment with said indicator pin, and that a top end of said indicator pin is received in said through hole of said trigger button wherein said top end of said indicator pin is extended out of said through hole of said trigger button at such time when said trigger button is exerted on by an external force so as to cause said activation projection of said activation body to turn off said electrical circuit switch.

2. The emergency switch as defined in claim 1, wherein said top end of said indicator pin is different in color from said trigger button.

3. The emergency switch as defined in claim 1 further comprising a housing which is mounted on said base to shield said indicator pin, said electrical circuit switch, and said activation body.

* * * * *